US009038928B2

(12) United States Patent
Ye

(10) Patent No.: US 9,038,928 B2
(45) Date of Patent: May 26, 2015

(54) SPRAY GUN

(76) Inventor: Xiaodong Ye, Yuyao (CN)

( * ) Notice: Subject to any disclaimer, the term of this patent is extended or adjusted under 35 U.S.C. 154(b) by 609 days.

(21) Appl. No.: 13/360,713

(22) Filed: Jan. 28, 2012

(65) Prior Publication Data

US 2013/0193236 A1 Aug. 1, 2013

(51) Int. Cl.
*B05B 9/01* (2006.01)
*B05B 12/00* (2006.01)

(52) U.S. Cl.
CPC ..... *B05B 9/01* (2013.01); *B05B 12/002* (2013.01)

(58) Field of Classification Search
CPC ..... B05B 9/01; B05B 12/002
USPC ..... 239/525, 526, 569; D23/223, 224, 226, D23/214
See application file for complete search history.

(56) References Cited

U.S. PATENT DOCUMENTS 2,937,813 A * 5/1960 Rinkewich ..... 239/459
2,991,945 A * 7/1961 Rosenkranz ..... 239/459
3,520,338 A * 7/1970 Vest et al. ..... 141/128
3,598,293 A * 8/1971 Lee ..... 222/327
5,833,145 A * 11/1998 Smith ..... 239/526

* cited by examiner

*Primary Examiner* — Justin Jonaitis
(74) *Attorney, Agent, or Firm* — Matthias Scholl P.C.; Matthias Scholl

(57) ABSTRACT

A spray gun, including a gun body, a handle attached to the gun body, a fluid passageway, a handle switch, and a buckle. The fluid passageway is disposed in the gun body and the handle. The handle switch is movably disposed on the handle by a rivet for opening and shutting the fluid passageway. The buckle is movably disposed on the handle via a switch shaft. The spray gun employs the buckle as a locking mechanism that has fewer parts, and therefore costs are reduced and convenience, reliability, and durability improved. The spray gun can be operated with one hand only by swinging it once to open and swinging it again to close. As a result, the performance and quality of the spray gun are improved.

11 Claims, 13 Drawing Sheets

SPRAY GUN

BACKGROUND OF THE INVENTION

1. Field of the Invention

The invention relates to a spray gun for gardens, gardening, and cleaning.

2. Description of the Related Art

Conventional spray guns on the market include a handle and a top plug with a spring mechanism as shown in FIG. 12. Their operating principle is as follows: when the handle is pressed, the water comes out, when the handle is loosened, the top plug, under the action of the spring, returns and seals. Spray guns with such a structure are a bit inconvenient for users. More specifically, when the spray guns are required for nonstop spray, users have to press the handle all the time and feel tired when more time is needed. Consequently, a lock catch 14*b* with a triangular ring, having a rotating shaft, is disposed on such spray guns. However, they must be operated by two hands. In other words, when a user uses one hand to hold the handle, he has to use his fingers and nails of the other hand to release the lock catch 14*b*, turn it to a larger angle (e.g. 45°) and meanwhile make sure the lock catch is able to fasten the inside of the upper edge of the handle. When a user intends to stop the spray gun, he also needs to use one hand to tightly hold the handle, and to allow the lock catch to be removed, he has to use his fingers and nails of the other hand to release the lock catch 14*b*, turn it to a larger angle (e.g. 45°) again, and meanwhile make sure the lock catch is able to fasten the buckling position at the upper edge of the handle. It is seen from the above description that it is troublesome to operate the spray guns by two hands.

SUMMARY OF THE INVENTION

In view of the above-described problems, it is one objective of the invention to provide a spray gun, which can be easily operated by one hand.

To achieve the above objective, in accordance with one embodiment of the invention, there is provided a spray gun, comprising a gun body, a handle attached to the gun body, a fluid passageway, a handle switch, and a buckle, wherein the fluid passageway is disposed in the gun body and the handle; the handle switch is movably disposed on the handle by a rivet for opening and shutting the fluid passageway; and the buckle is movably disposed on the handle via a switch shaft.

In a class of this embodiment, on the buckle is disposed with a roll-over stand, which is roughly shaped like a cylinder.

In a class of this embodiment, the number of the roll-over stand disposed on the buckle is two and they are symmetrical with each other.

In a class of this embodiment, on the two symmetrical roll-over stands of the buckle are respectively disposed with a through hole, which allows the switch shaft to pass through and is movably disposed with the buckle for rotation when users swing the spray gun.

In a class of this embodiment, on the buckle is disposed with a buckle head, which is roughly shaped like a convex arc. When the buckle rotates, the buckle head is clamped in a buckling position at the upper edge of the handle switch.

In a class of this embodiment, on the buckle is disposed with an inclined shoulder, which is roughly shaped like an inclined plane and allows the buckle to be positioned in a buckle holder that is disposed on the handle when the buckle returns.

In a class of this embodiment, on the buckle is disposed with a buckle tail, which is roughly shaped like a plane.

During the process when the buckle rotates to return under swing, the buckling position at the upper edge of the handle switch contacts with the buckle tail for the purpose of proper returning.

In a class of this embodiment, on the handle is disposed with switch shaft holes, which are symmetrical with each other and allow the switch shaft to pass through and allow the buckle to be movably disposed therein.

In a class of this embodiment, on the handle is disposed with a buckle holder to hold the buckle when the buckle returns.

Advantages of the invention are summarized below. The invention employs the buckle as a locking mechanism that has fewer parts, and therefore costs are reduced and convenience, reliability, and durability improved. The spray gun provided by the invention needs not to be operated by two hands. What users need to do is to simply swing the spray gun once by one hand to open it or lock it. Consequently, both the performance and the quality of the spray gun are improved.

Figure 1:
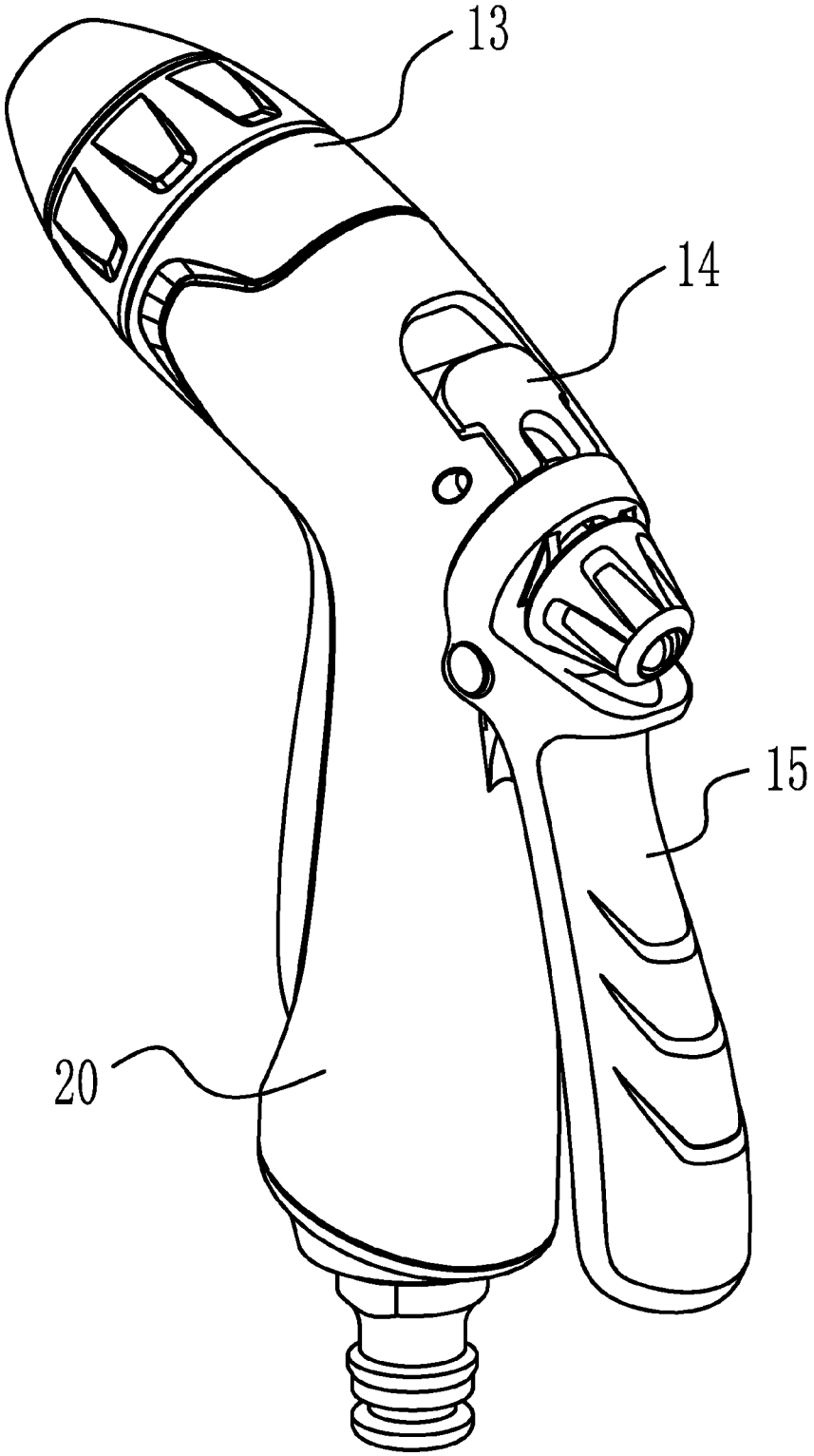
FIG. 1 is a schematic diagram of a spray gun in accordance with one embodiment of the invention.
Figure 2:
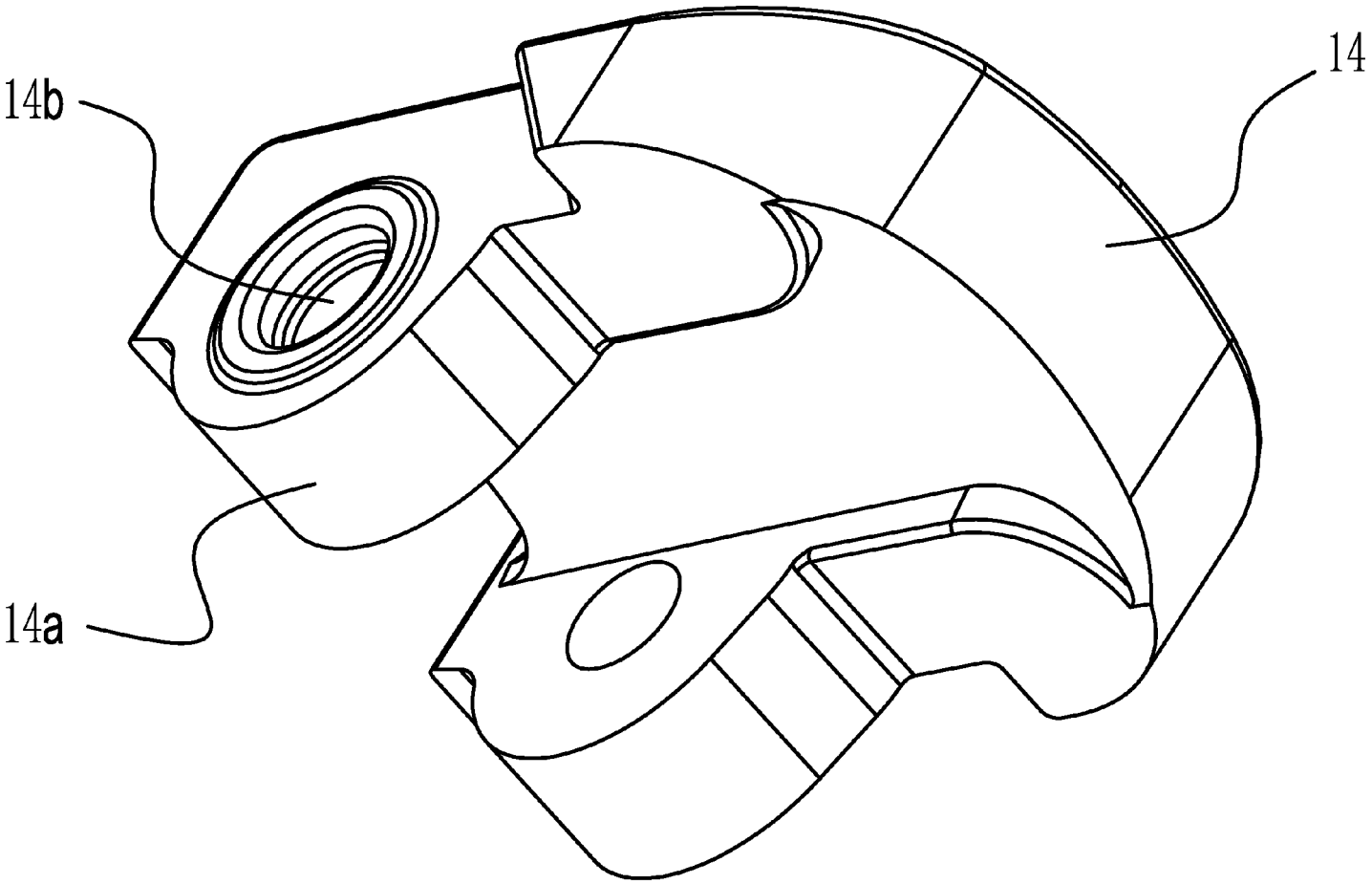
FIG. 2 is a schematic diagram of a buckle in accordance with one embodiment of the invention.
Figure 3:
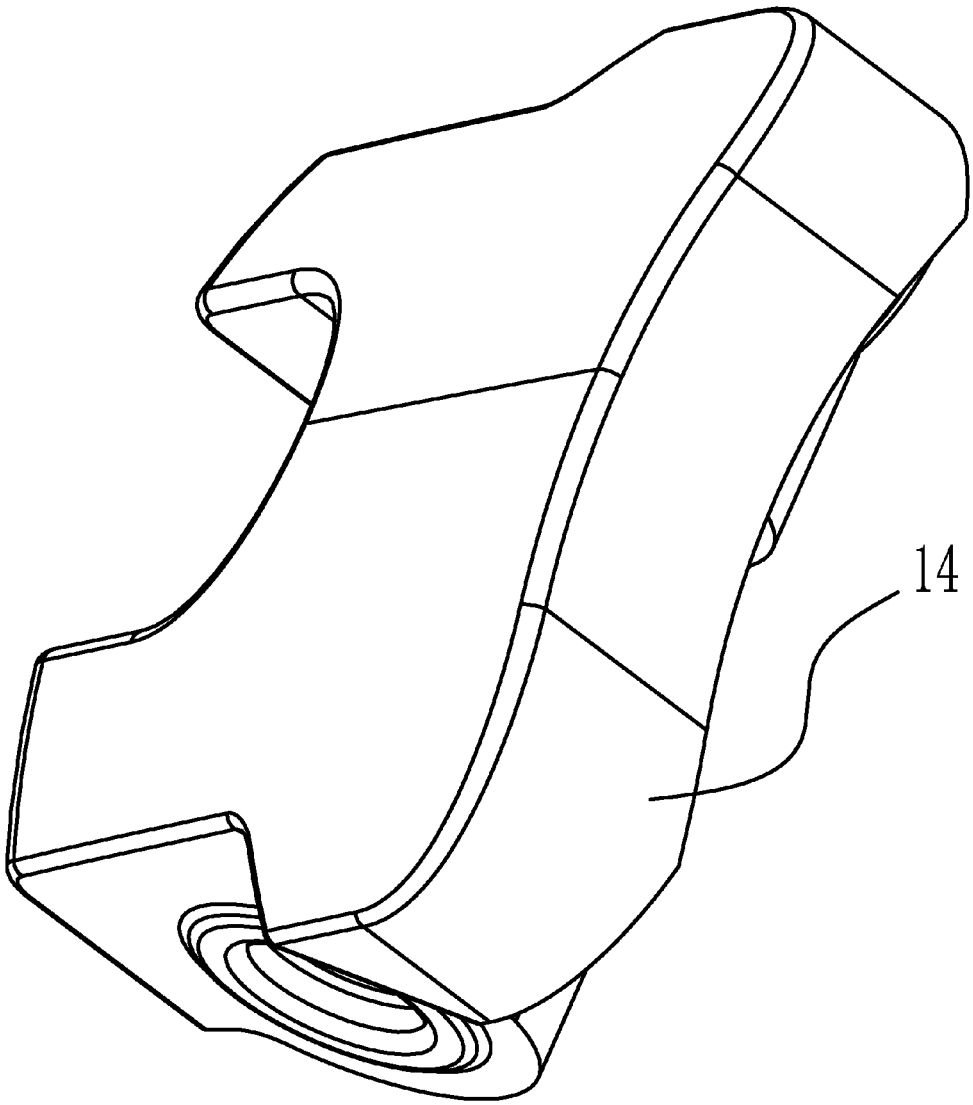
FIG. 3 is a schematic diagram of the buckle of the invention viewed from another angle.
Figure 4:
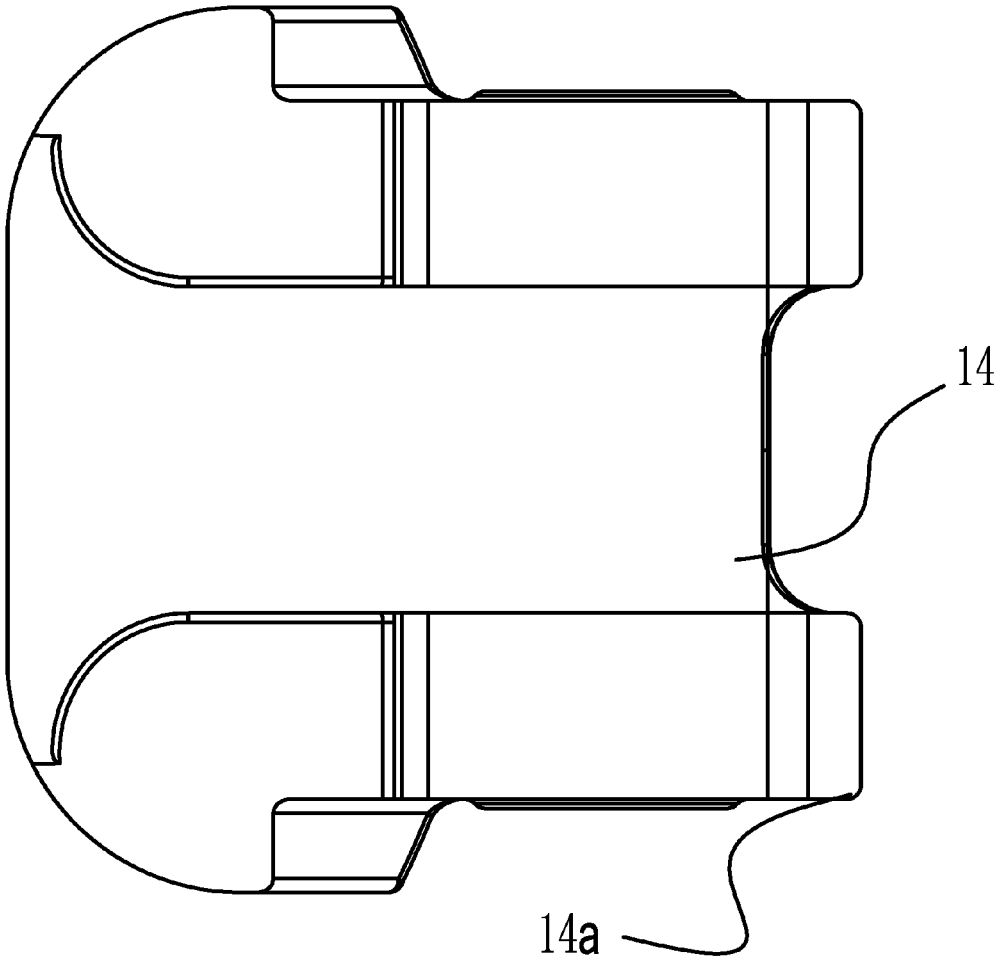
FIG. 4 is a front view of the buckle in accordance with one embodiment of the invention.
Figure 5:
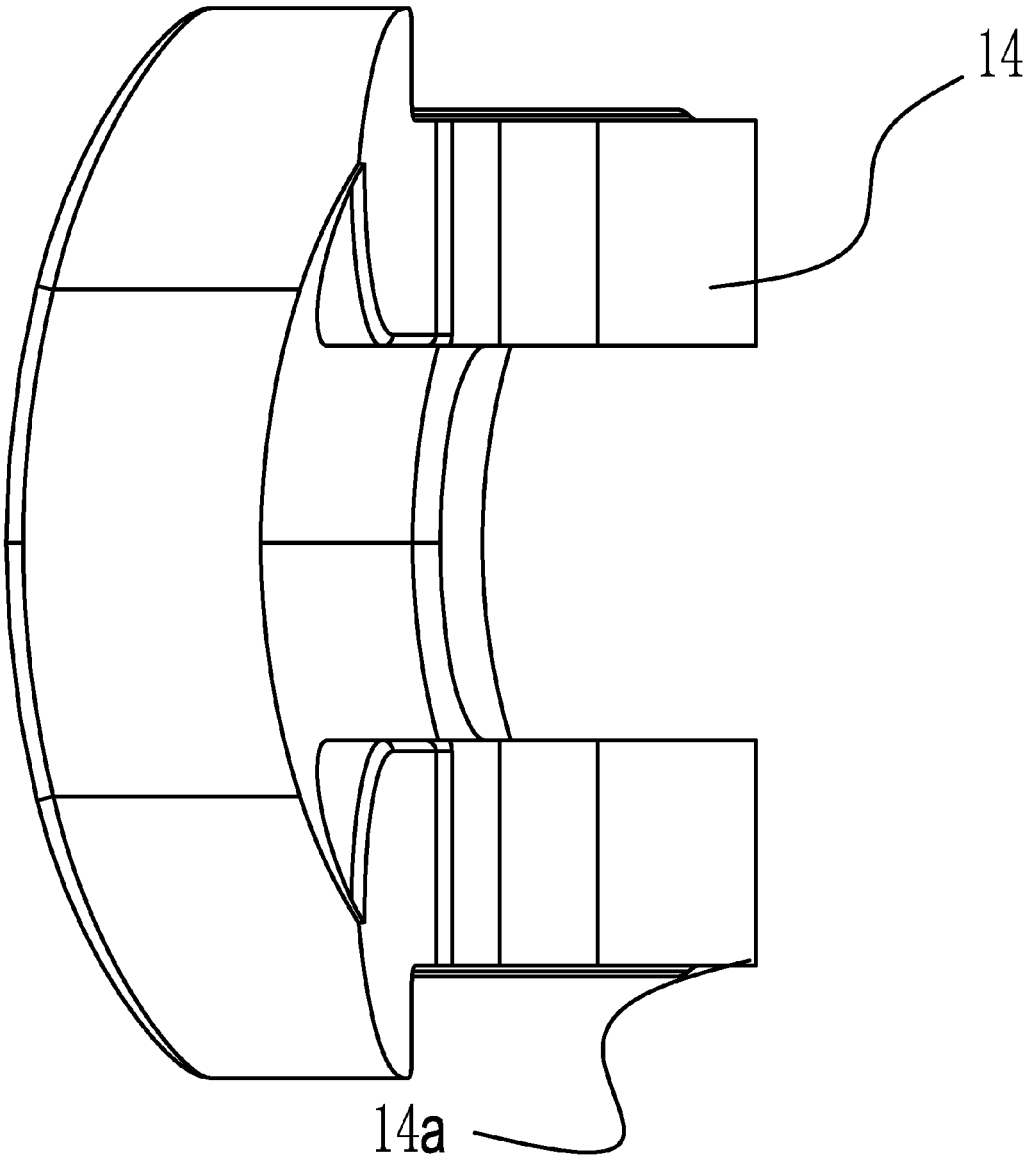
FIG. 5 is a left view of the buckle in accordance with one embodiment of the invention.
Figure 6:
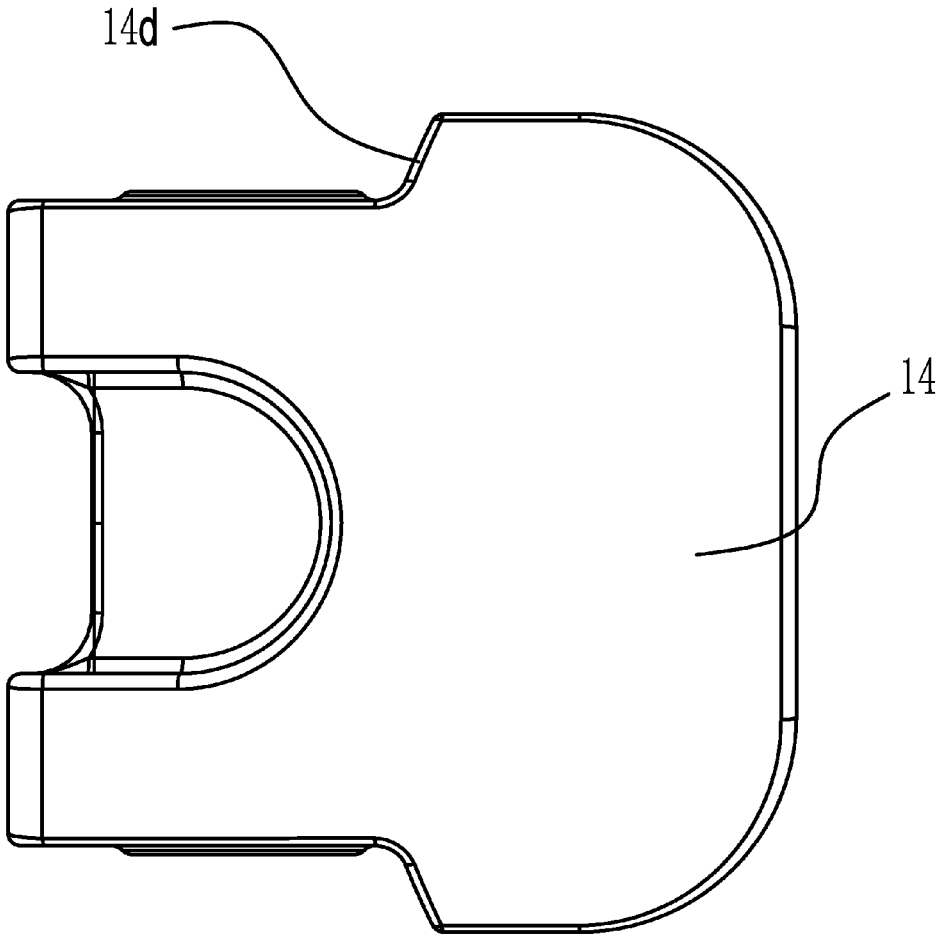
FIG. 6 is a rear view of the buckle in accordance with one embodiment of the invention.
Figure 7:
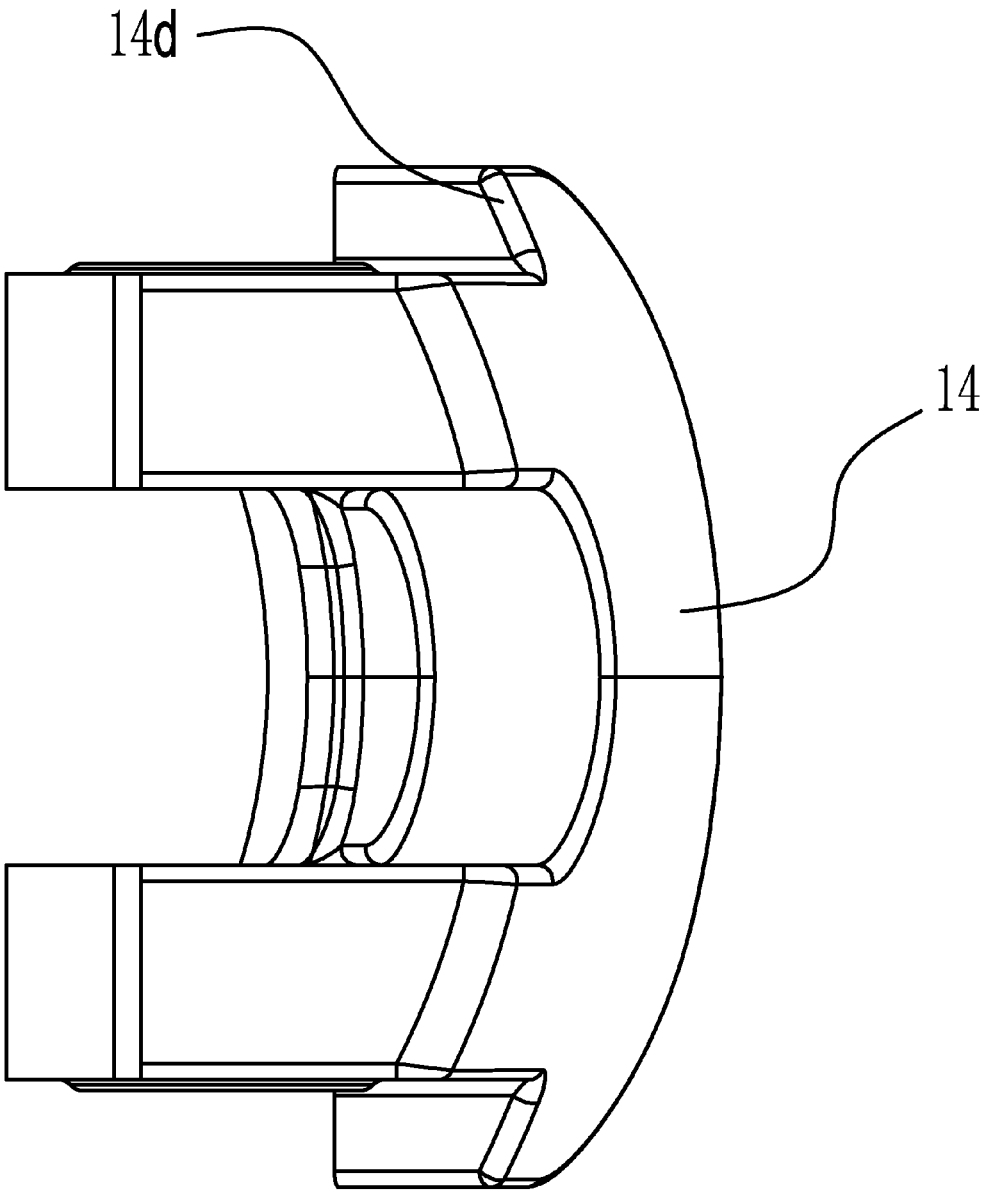
FIG. 7 is a right view of the buckle in accordance with one embodiment of the invention.
Figure 8:
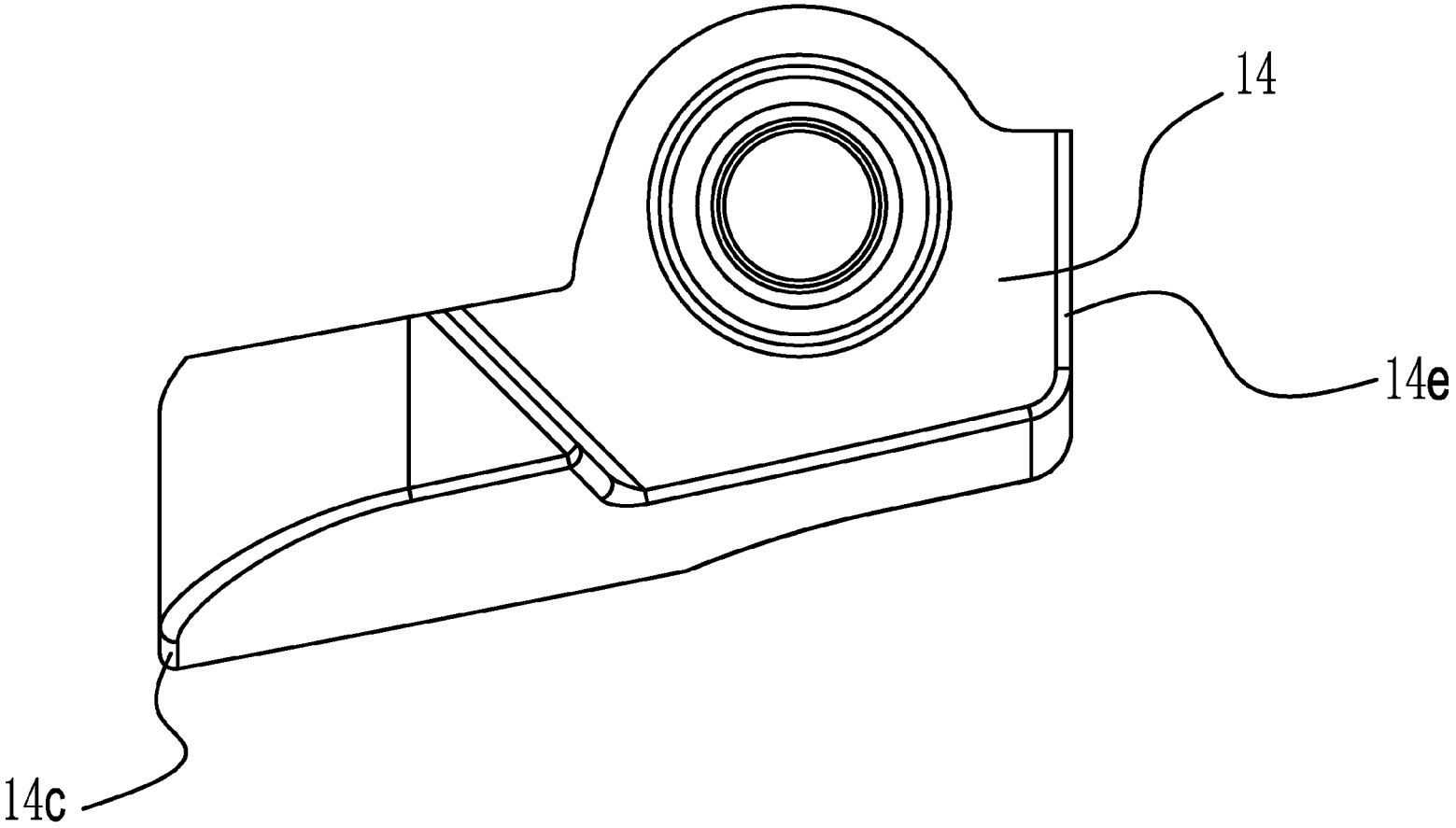
FIG. 8 is a top view of the buckle in accordance with one embodiment of the invention.
Figure 9:
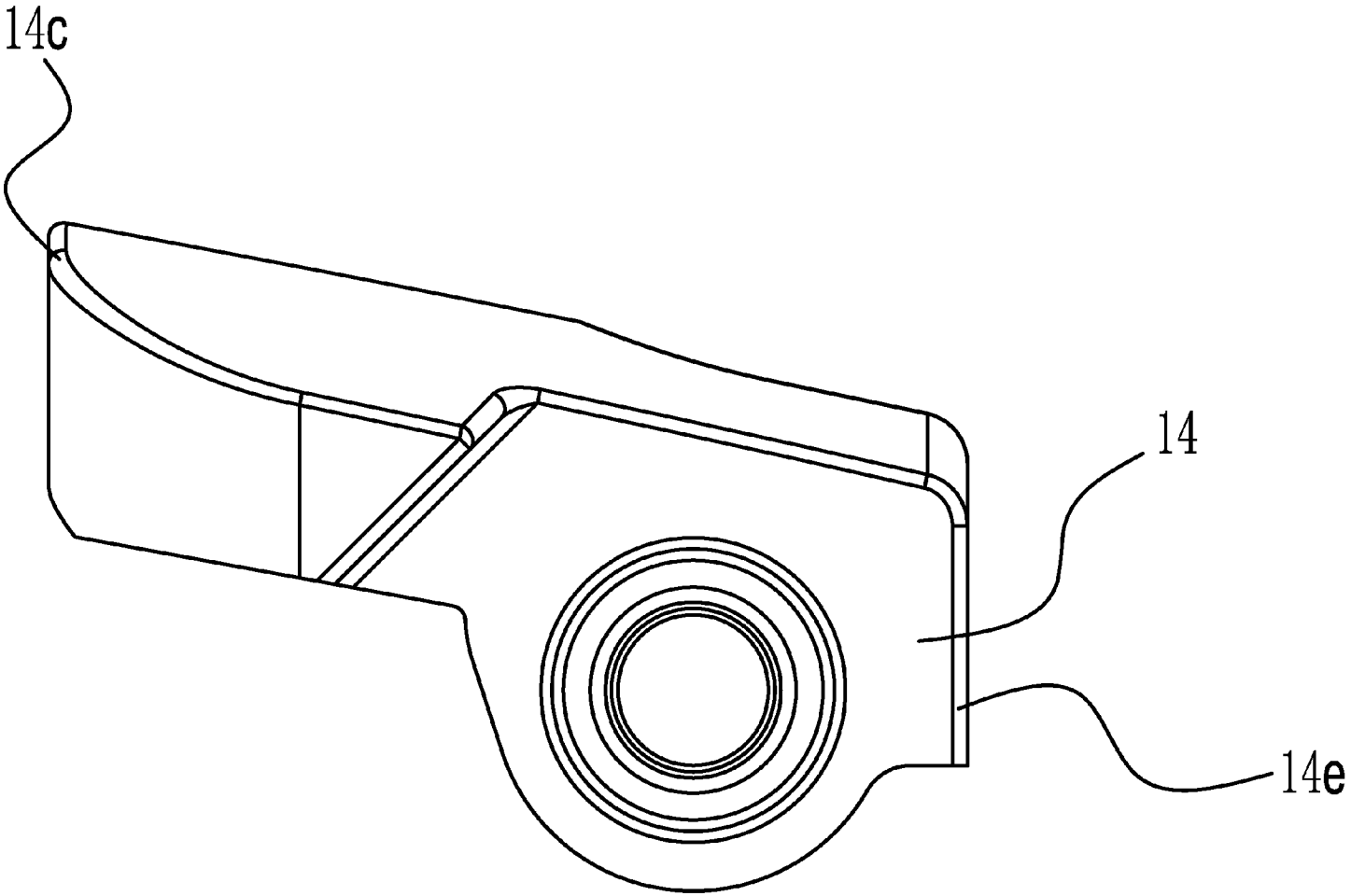
FIG. 9 is a bottom view of the buckle in accordance with one embodiment of the invention.
Figure 10:
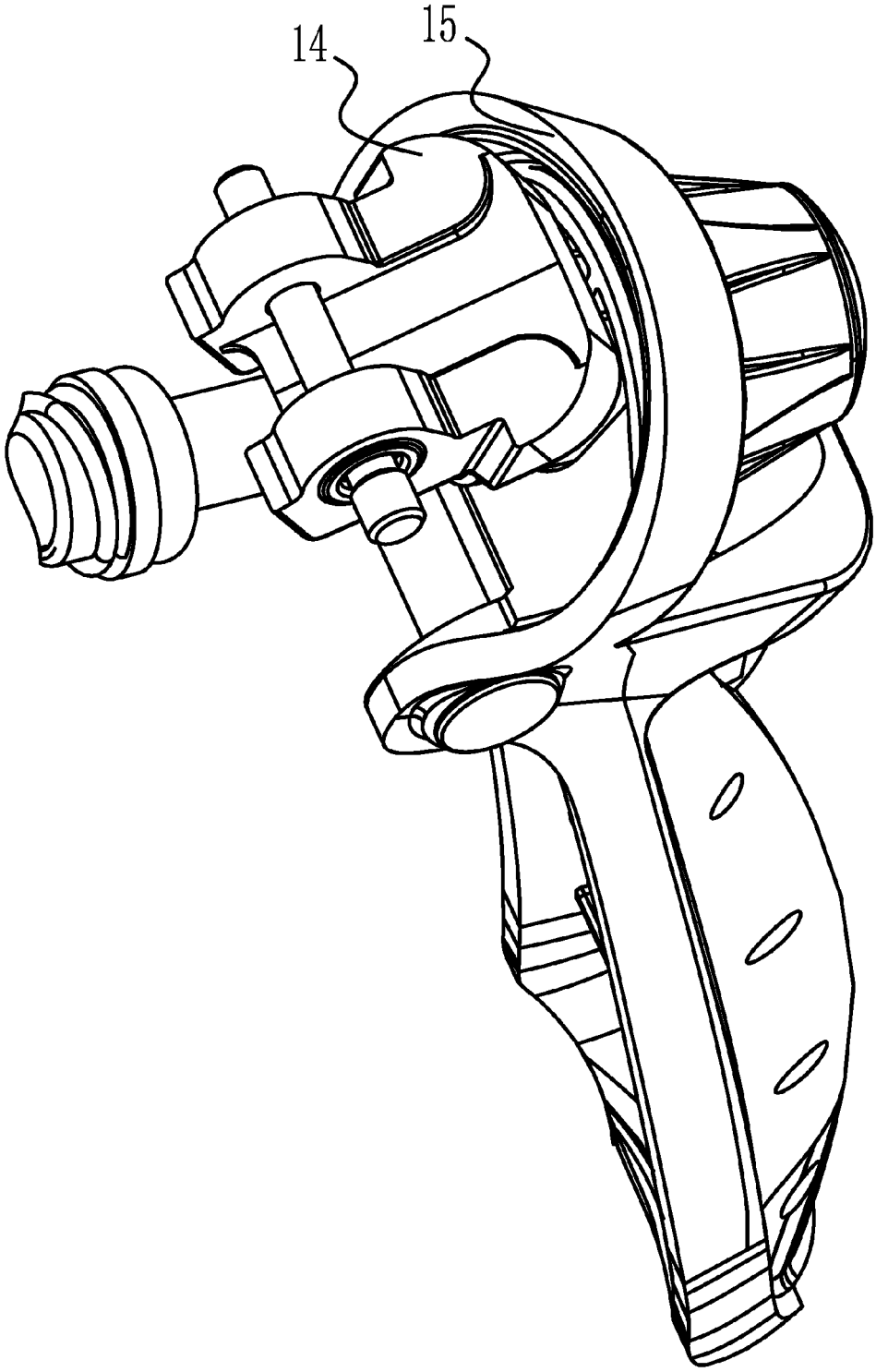
FIG. 10 is a partial three-dimensional diagram of a buckle that is clamped in a buckling position at the upper edge of a handle switch in accordance with one embodiment of the invention.
Figure 11:
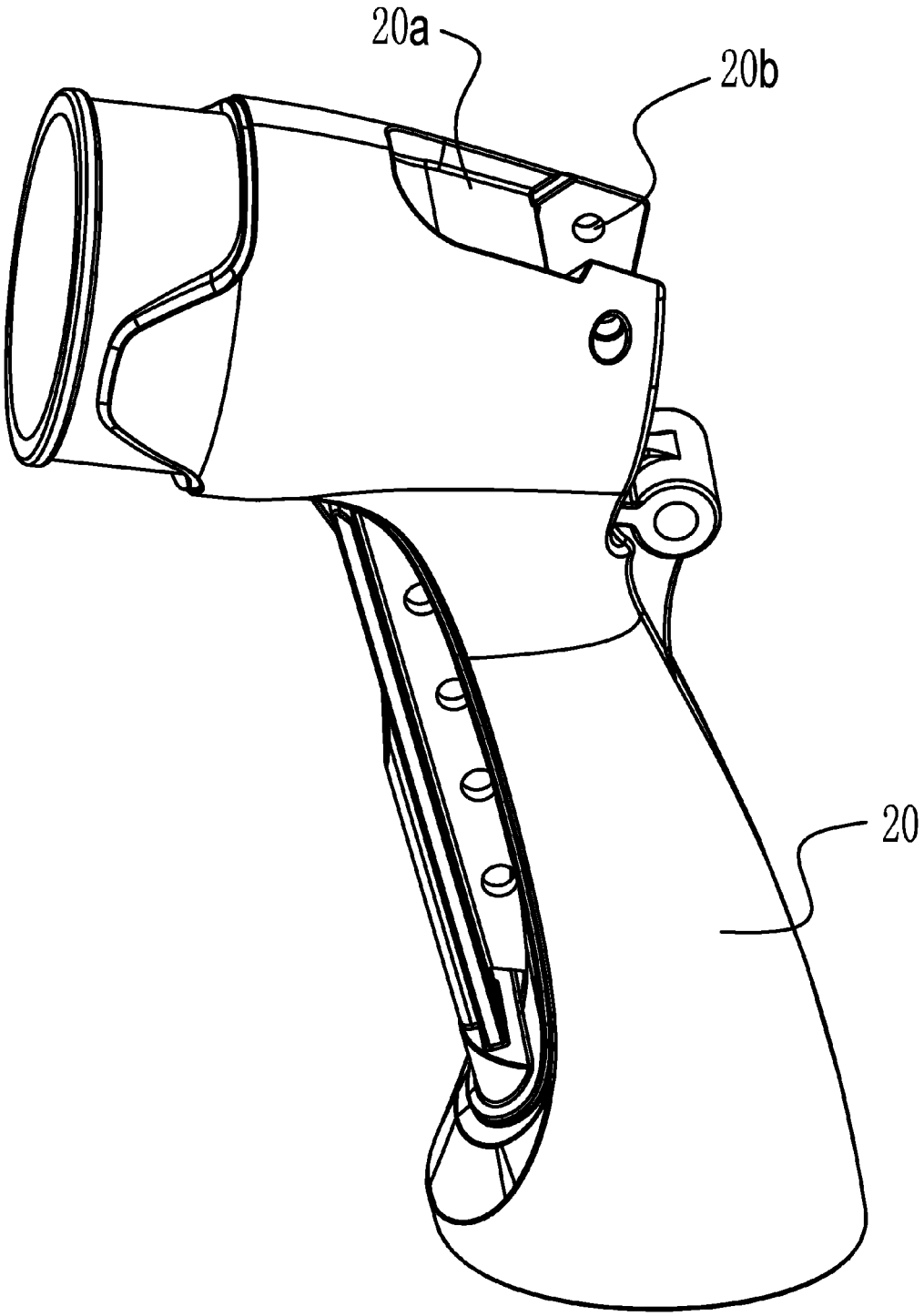
FIG. 11 is a three-dimensional diagram of a handle in accordance with one embodiment of the invention.
Figure 12:
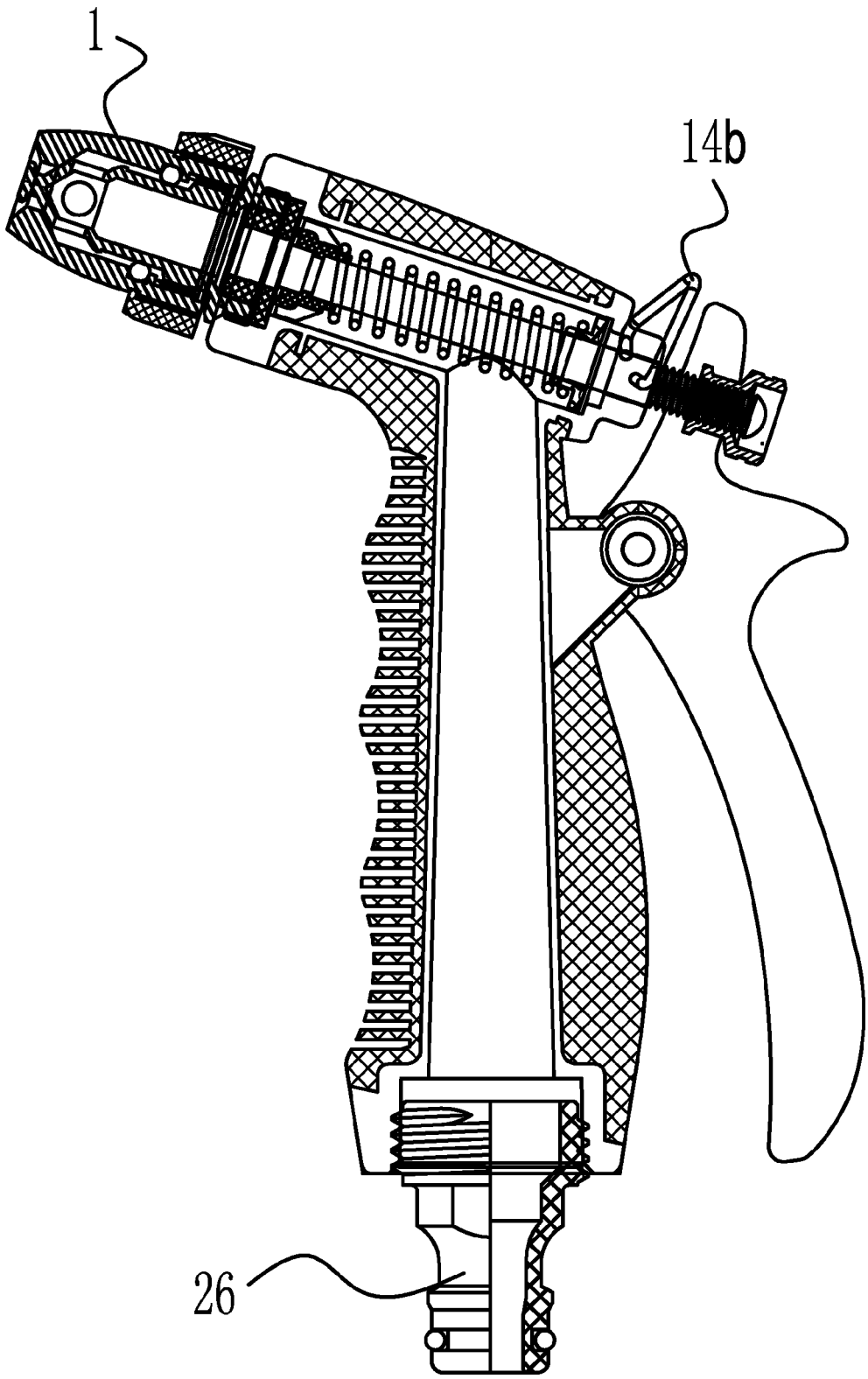
FIG. 12 (Prior art)
FIG. 12 is a sectional view of a spray gun with a lock catch in the art.

In the drawings, the following reference numbers are used: nozzle 1, nozzle cap 2, metal head 3, medium-thick sealing ring 4, shaft 5, large sealing ring 6, special sealing ring 7, plastic for nozzle 8, pull bar 9, pull bar spring 10, resilient spacer 11, small sealing ring 12, gun body 13, buckle 14, handle switch 15, pull bar nut 16, plastic for handle 17, switch shaft 18, rivet 19, handle 20, aluminum alloy nut 21, water-influx connecting sleeve 22, medium-thin sealing ring 23, inner water-influx connecting sleeve 24, sealing collar 25, male connector 26, extra-thick sealing ring 27.

DETAILED DESCRIPTION OF THE EMBODIMENTS

For further illustrating the invention, experiments detailing a spray gun are described below. It should be noted that the following examples are intended to describe and not to limit the invention.

A spray gun with a buckle as a locking mechanism, in accordance with the invention, comprises a gun body 13, a handle 20 attached to the gun body, and a fluid passageway that is disposed in the gun body and the handle. On the handle is movably disposed with a handle switch 15 by a rivet 19 and the handle switch is used to open and shut the fluid passageway. On the handle is also movably disposed with a buckle 14 via a switch shaft 18. The spray gun is compact and connected with a water hose; therefore it can be freely operated for swing and rotation.

On the buckle 14 is disposed with a roll-over stand 14*a*, which is roughly shaped like a cylinder and allows the buckle to rotate relatively.

The number of the roll-over stand 14*a* disposed on the buckle 14 is two and they are symmetrical with each other. Such a structure is favorable for rotation and prevents deflection.

On the two symmetrical roll-over stands 14*a* of the buckle 14 are respectively disposed with a through hole 14*b*, which allows the switch shaft 18 to pass through and is movably disposed with the buckle 14 therein for rotation when users swing the spray gun. The switch shaft 18 loosely fits with the through hole 14*b*, either a clearance fit or a movable fit, for the purpose of flexible swing and rotation.

On the buckle 14 is disposed with a buckle head 14*c*, which is roughly shaped like a convex arc. When the buckle 14 rotates, the buckle head is clamped in a buckling position at the upper edge of the handle switch 15, which is movably disposed on the handle by the rivet 19 to open and shut the fluid passageway. The head of the buckle head 14*c* is roughly shaped like a convex arc, and the buckling position at the upper edge of the handle switch 15 has an arc-shaped and big raised edge, thereby allowing the buckle head and the handle switch to easily fit together.

On the buckle 14 is disposed with an inclined shoulder 14*d*, which is roughly shaped like an inclined plane and allows the buckle 14 to be positioned in a buckle holder 20*a* that is disposed on the handle 20 when the buckle 14 returns.

On the buckle 14 is disposed with a buckle tail 14*e*, which is roughly shaped like a plane. During the process when the buckle 14 rotates to return under swing, the buckling position at the upper edge of the handle of the handle switch 15 contacts with the buckle tail 14*e* for the purpose of proper returning.

On the handle 20 is disposed with switch shaft holes 20*b*, which are symmetrical with each other and allow the switch shaft 18 to pass through and allow the buckle 14 to be movably disposed therein. It should be noted that the above components must be loose fit rather than tight fit.

On the handle 20 is disposed with a buckle holder 20*a*, which allows the buckle 14 to be positioned therein after the buckle 14 returns. It is understood that the buckle holder must be larger than the overall size of the buckle and thus allows the buckle to be easily placed.

The spray gun provided by the invention needs not to be operated by two hands. What users need to do is to simply swing the spray gun once by one hand to open it or lock it. Consequently both the performance and the quality of the spray gun are improved. When a user presses the handle switch and swings the spray gun once, the buckle will be clamped for continuous spray. When the user presses the handle switch and swings the spray gun again, the buckle will return. Certainly, users may operate the spray gun by pressing or loosening the handle switch and use the buckle as needed.

Figure 13:
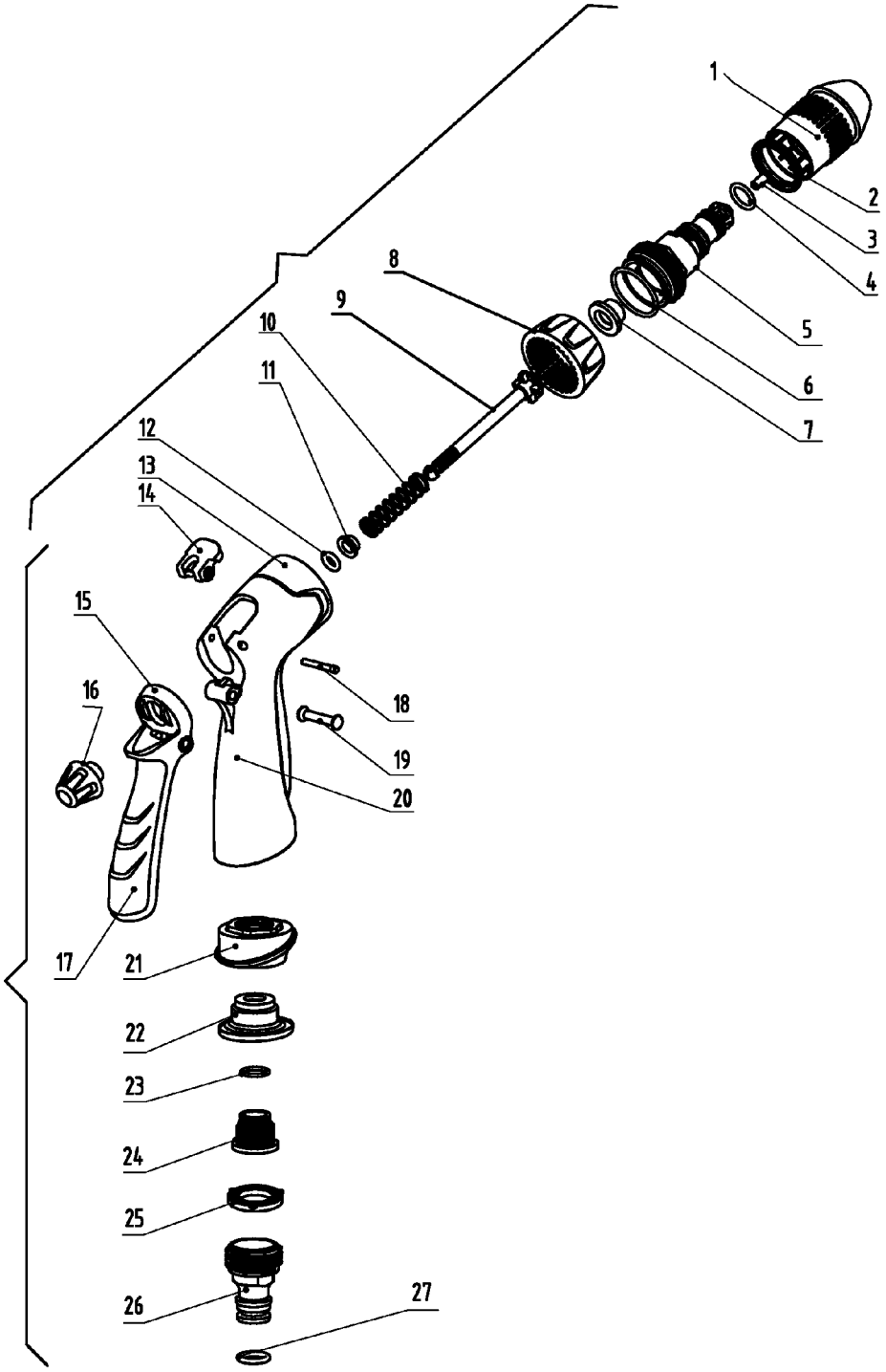
FIG. 13 is an exploded view of a spray gun in accordance with one embodiment of the invention.

As shown in FIG. 13, a spray gun with a buckle as a locking mechanism, in accordance with the invention, comprises a nozzle 1, a nozzle cap 2, a metal head 3, a medium-thick sealing ring 4, a shaft 5, a large sealing ring 6, a special sealing ring 7, plastic for nozzle 8, a pull bar 9, a pull bar spring 10, a resilient spacer 11, a small sealing ring 12, a gun body 13, a buckle 14, a handle switch 15, a pull bar nut 16, plastic for handle 17, a switch shaft 18, a rivet 19, a handle 20, an aluminum alloy nut 21, a water-influx connecting sleeve 22, a medium-thin sealing ring 23, an inner water-influx connecting sleeve 24, a sealing collar 25, a male connector 26, and an extra-thick sealing ring 27. The nozzle 1, the nozzle cap 2, the metal head 3, the medium-thick sealing ring 4, the shaft 5, the large sealing ring 6, the special sealing ring 7, the plastic for nozzle 8, the pull bar 9, the pull bar spring 10, the resilient spacer 11, and the small sealing ring 12 are disposed on the upper portion of the spray gun in turn while the aluminum alloy nut 21, the water-influx connecting sleeve 22, the medium-thin sealing ring 23, the inner water-influx connecting sleeve 24, the sealing collar 25, the male connector 26, and the extra-thick sealing ring 27 are disposed on the lower portion of the spray gun in turn. The pull bar 9 and the pull bar spring 10 are disposed with the resilient spacer 11 and the small sealing ring 12. The pull bar 9 passes through the gun body 13, the lower part of the buckle 14, and then extends through the handle switch 15 to connect with the pull bar nut 16. The plastic for handle 17 is connected with the handle switch 15. Consequently, when the handle switch 15 is not pressed, the pull bar 9, under the action of the pull bar spring 10, shuts the fluid passageway to stop the water from spraying, whereas when the handle switch 15 is pressed, the pull bar 9, under the action of the pull bar spring 10, opens the fluid passageway to allow the water to spray out. Moreover, users can only use one hand to operate the spray gun. What they need to do is to simply swing the spray gun once to lock it and swing again to open it. Such a spray gun provided by the invention improves the overall performance and quality of the spray gun. When a user presses the handle switch and swings the spray gun once, the buckle will be clamped for continuous spray. When the user presses the handle switch and swings again, the buckle will return. After the user loosens his hand, the pull bar 9, under the action of the pull bar spring 10, will shut the fluid passageway to stop the water from coming out.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A spray gun, comprising:

a) a gun body;

b) a handle attached to the gun body;

c) a fluid passageway;

d) a handle switch comprising a raised edge;

e) a buckle comprising a lower part and a buckle head; and f) a pull bar;

wherein:

the fluid passageway is disposed in the gun body and the handle;

the handle switch is movably disposed on the handle by a rivet for opening and shutting the fluid passageway;

the buckle is movably disposed on the handle via a switch shaft;

the handle switch is movable between a first position in which the fluid passageway is open and a second position in which the fluid passageway is closed; and the pull bar is disposed in the gun body and extends through the gun body, the lower part of the buckle, and the handle switch.

2. The spray gun of claim 1, wherein on the buckle is disposed with a first roll-over stand, which is roughly shaped like a cylinder.

3. The spray gun of claim 2, wherein the buckle further comprises a second roll-over stand and the second roll-over stand is symmetrical to the first roll over stand.

4. The spray gun of claim 3, wherein on the first and second roll-over stands are respectively disposed with a through hole.

5. The spray gun of claim 1, wherein the buckle head is roughly shaped like a convex arc.

6. The spray gun of claim 1, wherein on the buckle is disposed with an inclined shoulder, which is roughly shaped like an inclined plane.

7. The spray gun of claim 1, wherein on the buckle is disposed with a buckle tail, which is roughly shaped like a plane.

8. The spray gun of claim 1, wherein on the handle is disposed with switch shaft holes, which are symmetrical with each other and allow the switch shaft to pass through and allow the buckle to be movably disposed therein.

9. The spray gun of claim 1, wherein on the handle is disposed with a buckle holder to hold the buckle when the buckle returns.

10. The spray gun of claim 1, wherein when in use, as the handle switch moves between the first position and the second position, the handle switch pulls or pushes the pull bar, the pull bar presses the buckle, the buckle rotates about the switch shaft, and the pull bar opens or shuts the fluid passageway.

11. The spray gun of claim 10, wherein:

when the handle switch is in the second position and is pressed by a user, the handle switch moves toward the first position, the handle switch pulls the pull bar, the pull bar presses the buckle, the buckle rotates about the switch shaft until the raised edge is clamped by the buckle head, the handle switch is retained in the first position, and the pull bar opens the fluid passageway; and when the handle switch is in the first position and is pressed by a user, the handle switch moves toward the second position, the handle switch pushes the pull bar, the pull bar presses the buckle, the raised edge is unclamped from the buckle head, and the pull bar shuts the fluid passageway.

* * * * *